US007909522B2

(12) United States Patent
Heaton et al.

(10) Patent No.: US 7,909,522 B2
(45) Date of Patent: Mar. 22, 2011

(54) PORTABLE PRINTER WITH ADJUSTABLE MEDIA TRAY

(75) Inventors: Guy Heaton, Orange County, CA (US); Chad Gundlach, Orange County, CA (US)

(73) Assignee: Datamax-O'Neil Corporation, Orlando, FL (US)

( * ) Notice: Subject to any disclaimer, the term of this patent is extended or adjusted under 35 U.S.C. 154(b) by 699 days.

(21) Appl. No.: 11/985,784

(22) Filed: Nov. 16, 2007

(65) Prior Publication Data

US 2008/0152416 A1 Jun. 26, 2008

Related U.S. Application Data

(60) Provisional application No. 60/859,382, filed on Nov. 16, 2006.

(51) Int. Cl.
*B41J 15/04* (2006.01)
*B65H 16/06* (2006.01)

(52) U.S. Cl. ..... 400/88; 400/613; 400/691; 242/578

(58) Field of Classification Search ..... 400/613, 400/621, 691, 88; 242/578
See application file for complete search history.

(56) References Cited

U.S. PATENT DOCUMENTS

| | | | | |
|---|---|---|---|---|
| 5,267,800 | A | 12/1993 | Petteruti et al. | |
| 5,524,993 | A | 6/1996 | Durst | |
| 5,813,343 | A * | 9/1998 | Harb | 101/407.1 |
| 5,997,193 | A | 12/1999 | Petterutti et al. | |
| 6,010,257 | A | 1/2000 | Petteruti et al. | |
| 6,364,550 | B1 | 4/2002 | Petteruti | |
| 6,431,492 | B1 * | 8/2002 | Chillscyzn | 242/577 |
| 7,387,458 | B2 * | 6/2008 | Monteith et al. | 400/609 |
| 2006/0180612 | A1 * | 8/2006 | Paas et al. | 222/182 |
| 2006/0216098 | A1 * | 9/2006 | Lyman | 400/613 |

FOREIGN PATENT DOCUMENTS

| | | | |
|---|---|---|---|
| JP | 2001253601 A | * | 9/2001 |
| JP | 2002205850 A | * | 7/2002 |
| JP | 2005035180 A | * | 2/2005 |

OTHER PUBLICATIONS

O'Neil Product Development, Inc., O'Neil Quick Reference Programming Guide, O'Neil Products Development, Inc., 2006, 68 pages, O'Neil Product Development, Inc., Irvine, CA.

* cited by examiner

*Primary Examiner* — Daniel J Colilla
(74) *Attorney, Agent, or Firm* — Carter, DeLuca, Farrell & Schmidt, LLP

(57) ABSTRACT

A portable printer includes a housing having a cavity defined therein which supports a roll of stock material for printing indicia thereon. The housing has a drive motor assembly configured to move the stock material through a paper path defined in the housing. A battery is loadable within a battery compartment disposed in the cavity and a cover assembly is pivotably supported on the housing and moveable from an open configuration for loading the roll of stock material to a closed configuration to enable printing. A selectively adjustable media support assembly supports the roll of stock material and includes a paper tray having a cam-shaped stanchion which is slideable within a media support tray from a first position for supporting a roll of stock material of a first size to a second position for supporting a roll of stock material of a second size. The cam-shaped stanchion is also rotatable from a first orientation which allows selective, sliding adjustment of the paper tray and cam-shaped stanchion to a second orientation which locks the cam-shaped stanchion against the media support tray.

16 Claims, 19 Drawing Sheets

PORTABLE PRINTER WITH ADJUSTABLE MEDIA TRAY

CROSS REFERENCE TO RELATED APPLICATION

The present application claims the benefit of priority to U.S. Provisional Patent Application Ser. No. 60/859,382 filed on Nov. 16, 2006, the entire contents of which is incorporated by reference herein.

BACKGROUND

The present disclosure relates to portable printers and more particularly, the present disclosure relates to a portable label printer having a selectively adjustable media support assembly.

TECHNICAL FIELD

A portable printer is particularly suitable for printing onto stock material such as direct thermal media (DT media) which may include but is not necessarily limited to: labels, receipts, item labels, shelf labels/tags, ticket stubs, stickers, hang tags, price stickers, etc.). The stock material may be receipt paper, paper which is releasable attached to a web carrier (or label-stock) or paper which includes a roll of continuous label material without a web carrier (so-called "linerless stock"). In one type of linerless stock, the adhesive side of the strip is releasable from the face side of the next convolution of the roll, similar to a roll of adhesive tape. When unwound, linerless stock can be difficult to convey through a printer and may ultimately foul the device during use due to the build-up of transferred adhesive.

Portable printers are typically used in warehouses, on factory floors and in retail establishments for ticket printing and inventory control, e.g., car return establishments. Ideally, the printers weigh only a few pounds and are small enough to be easily carried during use and/or easily attached to a buckle or a harness-type device. This enables the user to print labels or receipts on demand without having to retrieve the printed label from a printing station. Because the printer is portable, the printer communicates with a host terminal or network connection via radio or optical interface and therefore does not necessarily require a cable connection.

Most portable printers are designed for use with one type of printing media or one particular size of print media, e.g., 2-inch label stock or 3-inch label stock. Other portable printers may be configurable to accommodate different stock when loading different media types and sizes. Many of the media support stanchions associated with these printers are not very versatile and not easily configurable or re-configurable for loading different sizes of stock material. As a result, even though these particular portable printers may be capable of accommodating variously-sized printing media, the difficulty of re-configuring the printer to support a different stock material may ultimately dissuade a user from using the portable printer in this fashion.

As a result, it would therefore be desirous to provide a portable printer which enables a user to easily configure and re-configure the media support stanchions for differently-sized media types.

SUMMARY

The present disclosure relates to a portable printer which includes a housing having a cavity defined therein. The housing is configured to house a roll of stock material (e.g., direct thermal media such as a roll of linerless paper, label or receipt paper) for printing indicia thereon and includes a drive motor assembly disposed thereon which moves the stock material through a paper path defined in the housing. A battery is loadable within a battery compartment disposed in the cavity and a cover assembly is pivotably supported on the housing. The cover assembly is selectively moveable from an open configuration for loading the roll of stock material to a closed configuration to enable printing. A flexible print head may be releasably or securely mounted to the cover assembly.

A selectively adjustable media support assembly is included which supports the roll of stock material. The media support assembly has a paper tray including a cam-shaped stanchion. The paper tray is slideable from a first position for supporting a roll of stock material of a first size to a second position for supporting a roll of stock material of a second size. The cam-shaped stanchion is rotatable from a first orientation which allows selective sliding adjustment of the paper tray and cam-shaped stanchion to a second orientation which locks the cam-shaped stanchion against a media support tray disposed in the housing.

In one embodiment, the media support assembly includes an arcuately-shaped flange which extends inwardly therefrom. The arcuately-shaped flange is configured to engage and at least partially encircle the roll of stock material when the media support assembly is slid into engagement with the roll of stock material. The cam-shaped stanchion may include a series of ribs which facilitate rotation and the cam-shaped stanchion between the first and second orientations. The cam shaped stanchion of the selectively adjustable media support assembly may be configured to prevent the cover assembly from moving to the closed configuration when the cam-shaped stanchion is disposed in the first orientation.

In one envisioned embodiment, a release mechanism operably couples to the housing and engages the cover assembly when the cover assembly is moved to the closed configuration. The release mechanism includes a pair of catches which mechanically engage a corresponding pair of mechanical interfaces on the cover assembly to secure the cover assembly relative to the housing.

In another embodiment, the portable printer includes a platen roller operably coupled to the drive assembly. The platen roller is made from a material which pulls the roll of stock material through the paper path but does not adhere to the stock material as the stock material passes over the platen roller.

In yet another embodiment, the housing includes one or more sensors disposed therein, the sensors being configured to regulate and monitor printing functions and parameters and relay information relating to the printing functions and parameters back to an internally-disposed PC board and/or remote network connection. The printing functions and parameters may include: size of stock material, stock material speed, "out of stock material" alert, "low stock material" alert, stock material thickness, stock material malfunction, printing malfunction, print speed, cover configuration, print head temperature and combinations thereof.

In one embodiment, the selectively adjustable media support assembly includes a plurality of interchangeable snap inserts for supporting rolls of stock of varying diameters.

The present invention may also relate to a portable printer having a housing with a cavity defined therein. The cavity supports a roll of stock material for printing indicia thereon and the housing includes a drive motor assembly configured to move the stock material through a paper path defined in the housing. A flexible print head may be releasably or securely mounted to the cover assembly. A battery is loadable within a battery compartment disposed in the cavity and a cover assembly is pivotably supported on the housing and is moveable from an open configuration for loading the roll of stock material to a closed configuration to enable printing.

A selectively adjustable media support assembly is included which supports the roll of stock material. The media support assembly has a paper tray including a cam-shaped stanchion. The paper tray is slideable within a media support tray from a first position for loading a roll of stock material of a particular size to a second position for securely supporting the roll of stock material in the housing. The cam-shaped stanchion is rotatable from a first orientation which allows selective sliding adjustment of the paper tray and cam-shaped stanchion to a second orientation which locks the cam-shaped stanchion against the media support tray. The paper tray may be configured to include an arcuately-shaped flange which extends inwardly therefrom and which engages and at least partially encircles the roll of stock material when the paper tray is slid into the second position. One or more sensors may be disposed in the housing and configured to automatically sense information relating to the roll of stock material and relay the information back to at least one of an internally-disposed PC board and/or remote network connection. The sensed information may relate to the size of stock material, type of stock material, an "out of stock material" alert and/or a "low stock material" alert.

BRIEF DESCRIPTION OF THE DRAWINGS

Various embodiments of the subject instrument are described herein with reference to the drawings wherein.

DETAILED DESCRIPTION

Figure 1:
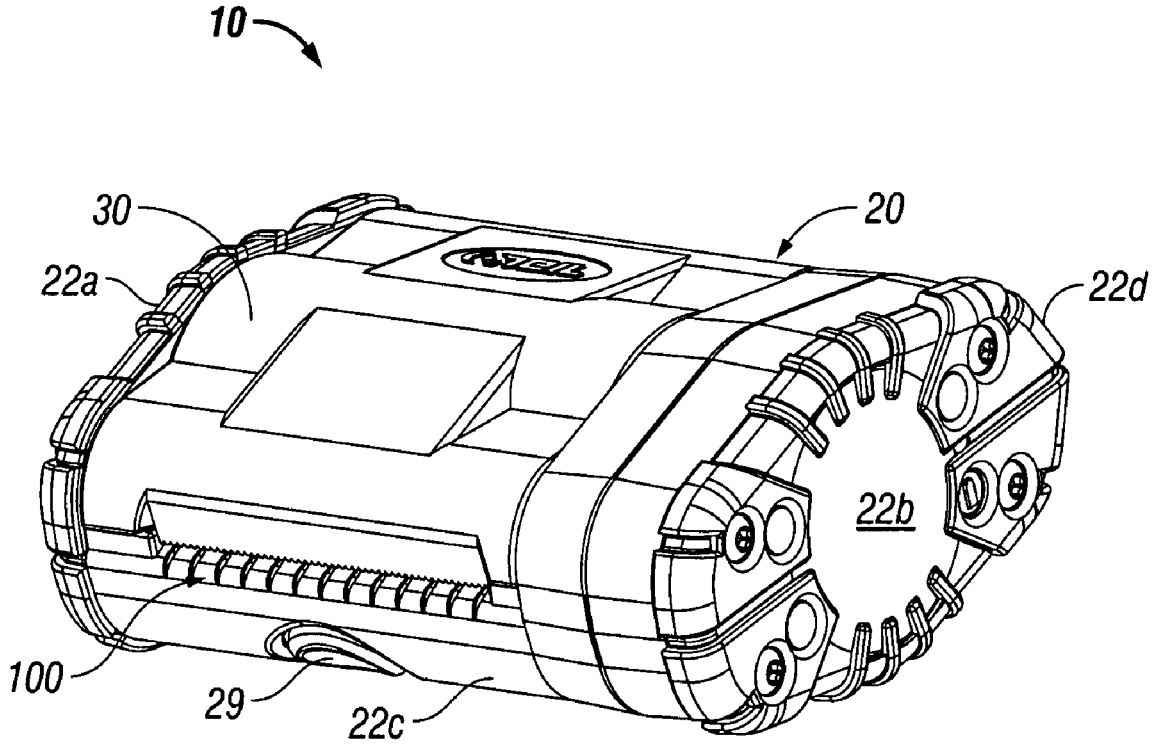
FIG. 1 is a front perspective view of a portable label printer in accordance with one embodiment of the present disclosure.
Figure 2:
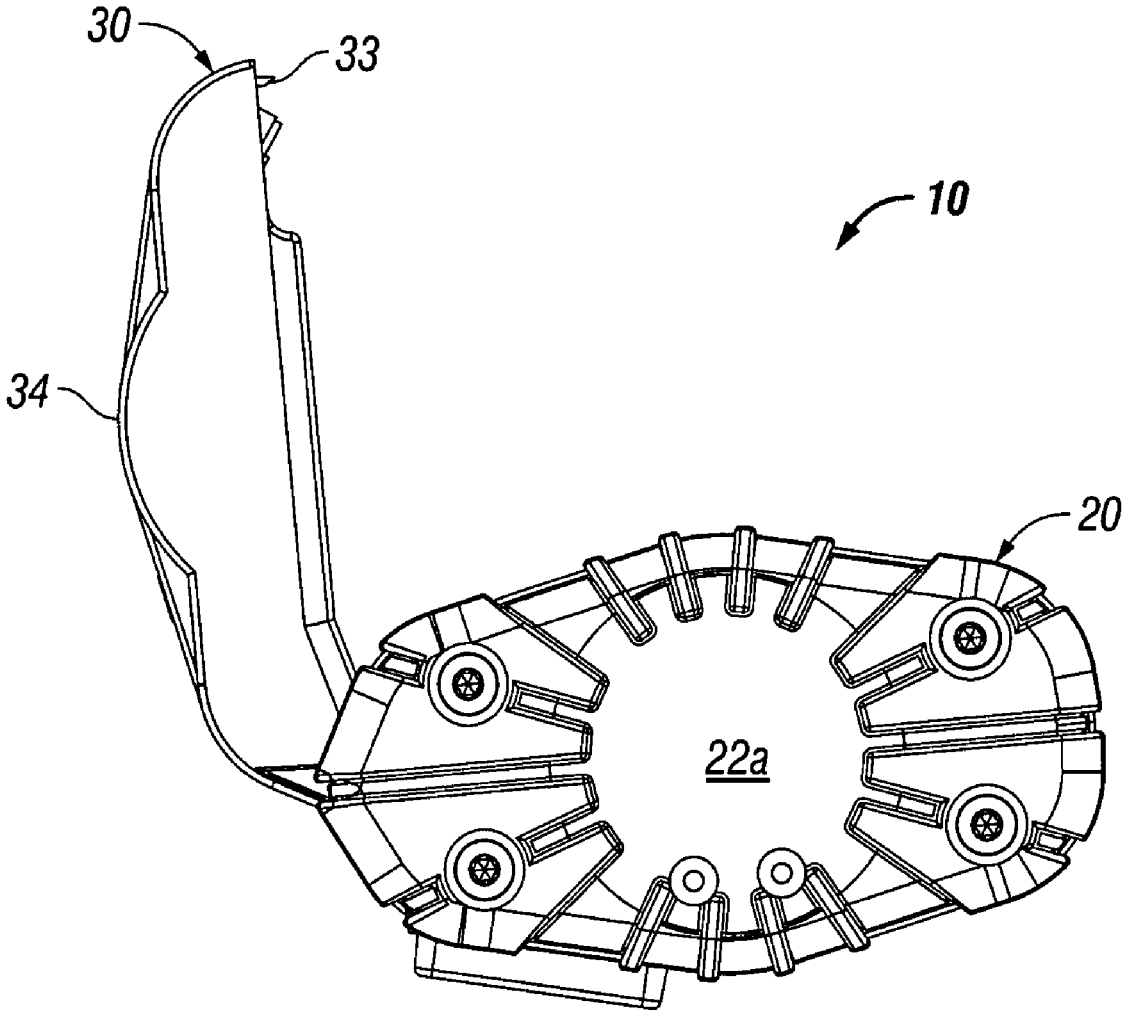
FIG. 2 is a left, side view of the printer of FIG. 1 shown in an open configuration.
Figure 3:
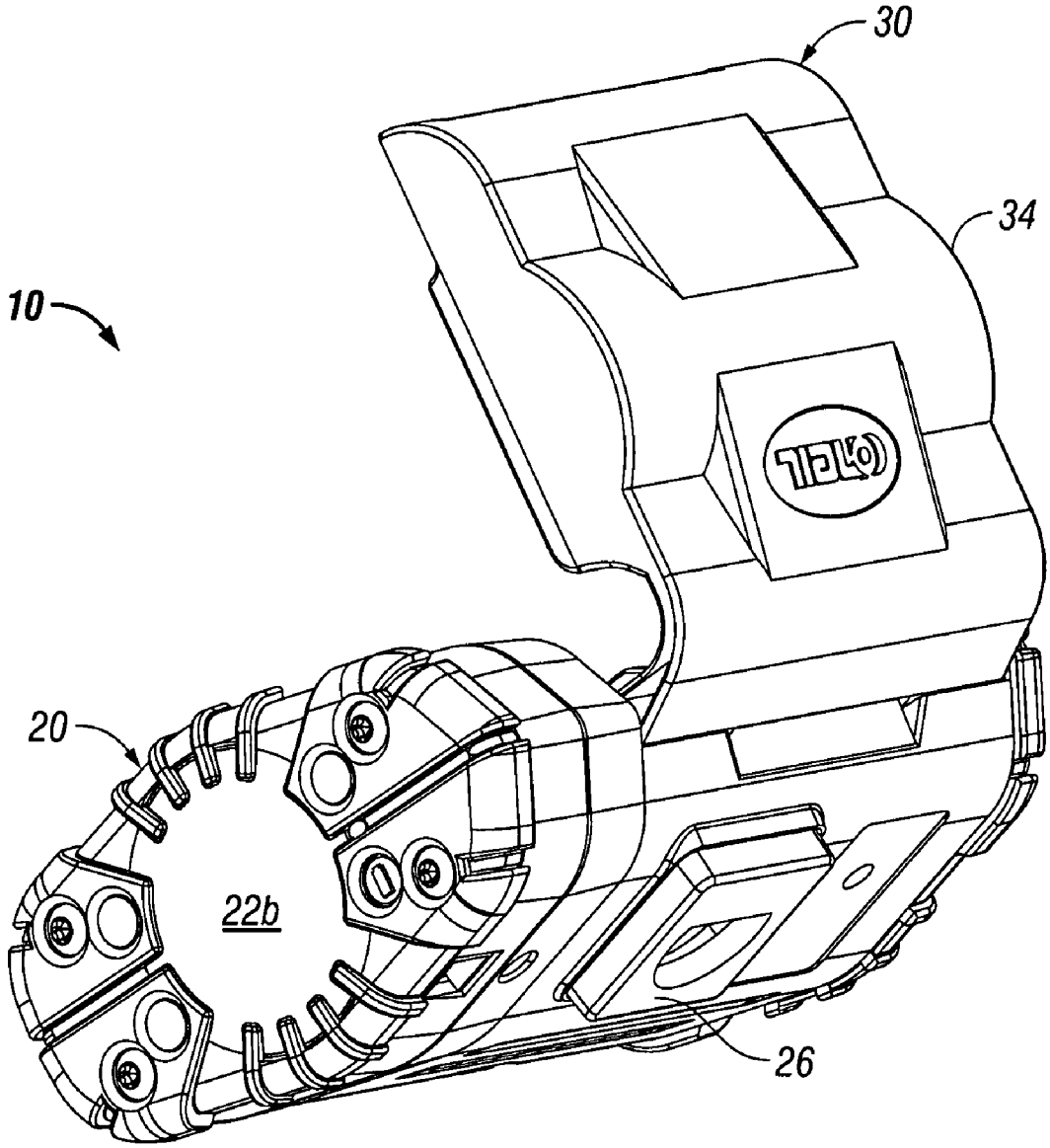
FIG. 3 is a rear perspective view of the printer of FIG. 1 shown in an open configuration.

Turning now in detail to FIGS. 1-9C which show the operating features and intercooperating components of the portable printer generally identified as printer 10. Printer 10 includes a housing 20 defined by sides 22*a* and 22*b*, front 22*c* and rear 22*d* and a selectively openable cover 30 for accessing the internal operating components of the housing 20. Housing 20 also includes a bottom tray 20*a* which defines a cavity 45 configured and dimensioned to receive a roll of stock material for printing indicia thereon (see FIG. 5). As used herein, the term "stock material" refers to any type of paper used for printing purposes such as direct thermal media used for printing receipts, labels, hang tags, merchandise information, etc.

More particularly, housing tray 20*a* is configured to operably engage a selectively engageable media support assembly 200 which releasably and rotatingly mounts paper stock (not shown) for printing purposes. Housing tray 20*a* also includes a battery slot 63 which is configured to slideably retain a battery 60 that supplies operating power to the printer 10. The front of the housing tray 20*a* includes a lip 47 that guides the paper stock to a roller or platen 48 which is configured to advance the paper stock as explained in more detail below. The lip 47 may include one or more sensors, e.g., 47*a*, 47*b* which cooperate with an internally disposed printed circuit board (PCBA) 130 or network connection (not shown) via a transceiver module 69 to provide information relating to the paper stock for printing purpose, e.g., size, type, thickness, low paper alert, etc. Details relating to the sensors 47*a* and 47*b* are explained below with respect to the operation of the printer 10. Lip 47 may also include a non-stick coating which prevents adherence to the stock material (especially linerless stock if used) as the stock is being advanced through the defined paper path 100. One or more additional PCBA boards (not shown) may be utilized to monitor one or more of these functions.

Figure 4:
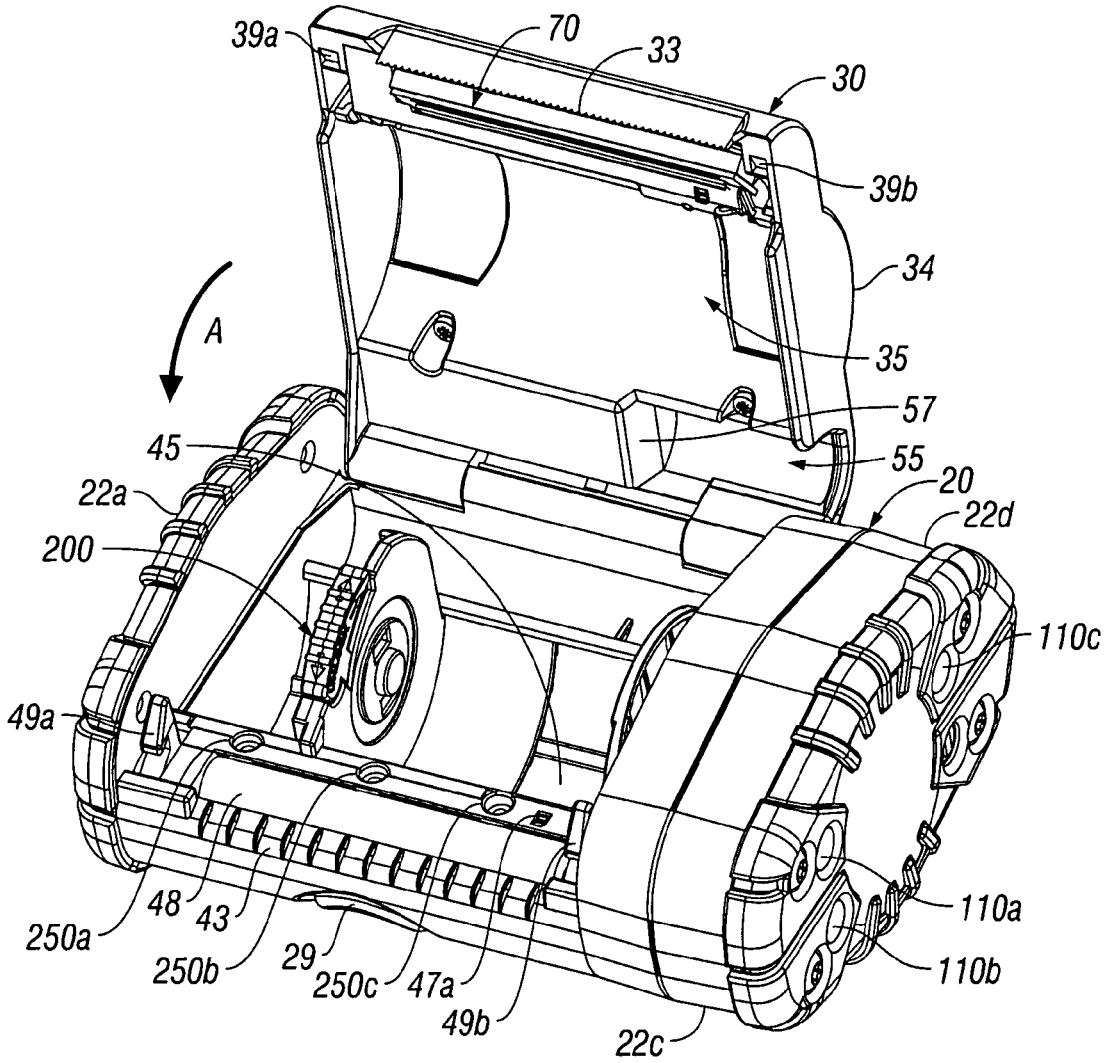
FIG. 4 is a front perspective view of the printer of FIG. 1 shown in an open configuration.
Figure 5:
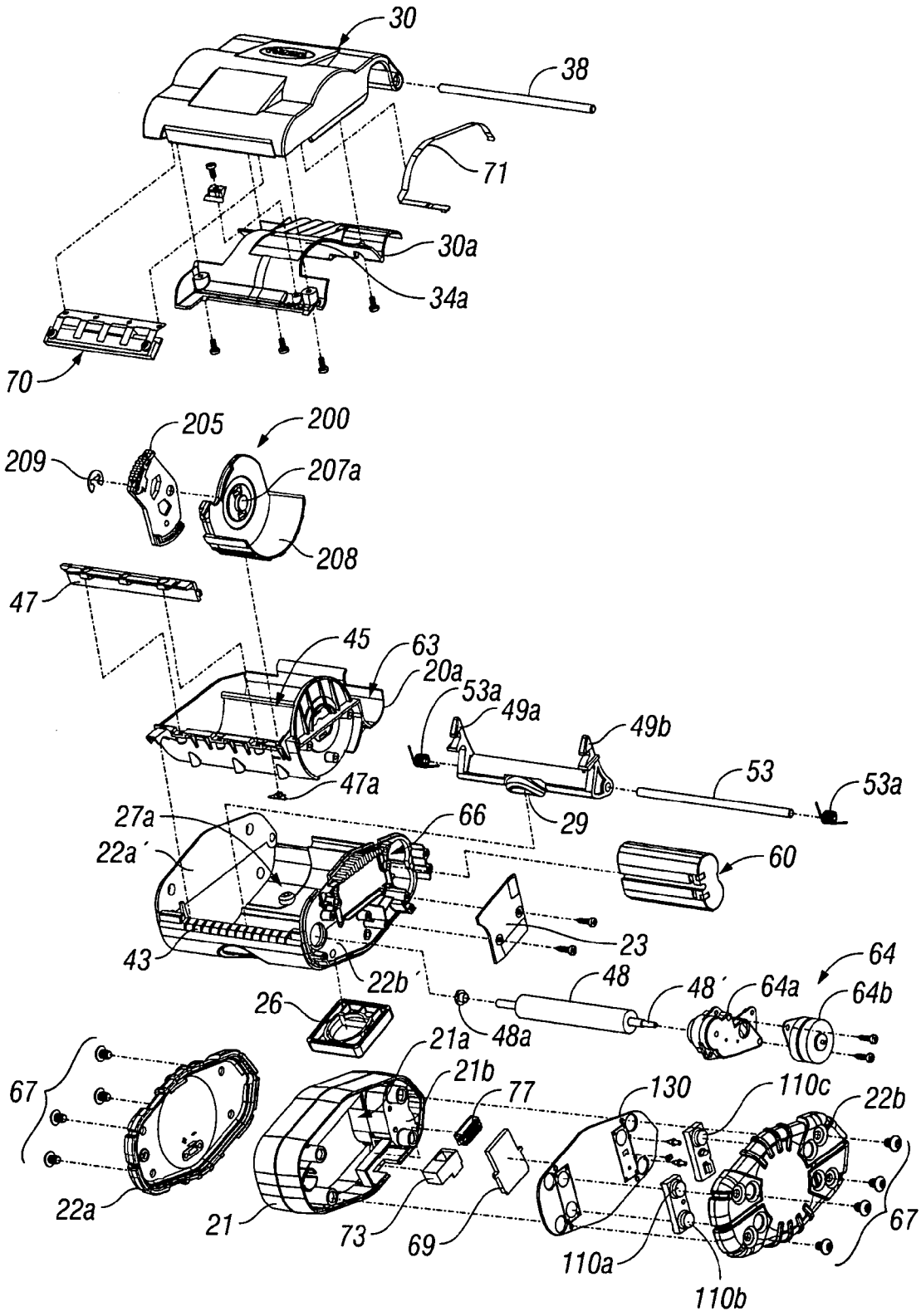
FIG. 5 is a perspective view of the printer of FIG. 1 with parts separated.

As best shown in FIGS. 4 and 5, housing tray 20*a* fits within a cavity 27*a* defined within housing 20 by sides 22*a*' and 22*b*' such that lip 47 generally aligns with a corresponding lip 43 disposed on front 22*c* of housing 20. Housing 20 also includes a locking and release mechanism 49 which is disposed within the front 22*c* of housing 20 about a pivot bar 53. Locking and release mechanism 53 includes catches 49*a* and 49*b* which operatively engage corresponding interfaces 39*a* and 39*b* in cover 30 to secure the inner-working components therein (e.g., battery 60, stock, etc.). A locking release 29, when depressed, pivots release mechanism 53 and disengages catches 49*a* and 49*b* from corresponding interfaces 39*a* and 39*b* to open the cover 30. One or more springs 53*a* are used to bias the cover 30 in an open configuration and to facilitate engagement of the mechanically cooperating locking components 49*a*, 49*b* and 39*a*, 39*b*, respectively.

The sides 22*a* and 22*b* of housing 20 are mounted to respective sides 22*a*' and 21 by one or more mechanical interfaces 67. Sides 22*a* and 22*b* may include various rubbers and other elastomeric components to protect the printer 10 during handling. A mounting clip 26 is also included and attached to the housing 20 which enables a user to mount the printer 10 to a belt or mechanical attachment on a belt loop. A battery aperture or slot 66 is defined in side 22*b*' and aligns with battery slot 63 in tray 20*a*. Battery aperture 66 also aligns with a terminal 21*b* disposed in spacer block 21 as discussed in more detail below. Battery aperture 66 may be dimensioned such that the battery 60 may only be inserted therein in one orientation to facilitate accurate loading. Battery aperture 66 may also include one or more interfaces which align with corresponding interfaces on the battery 60 to guide, secure and maintain the battery 60 in tight association within terminal 21*b* and to assure electrical continuity during handling and use.

Cover 30 includes an internal tray 30*a* which defines a cavity 35 dimensioned to house the roll of stock (not shown) when closed. One or more contours 34 and 34*a* are provided on the cover 30 and the tray 30*a*, respectively, to stabilize the roll of stock during rotation thereof. Cover 30 also includes a tear strip 33 disposed at the front thereof that is configured to allow a user to easily tear a strip of stock from the remaining roll after a label has been printed. Cover 30 may also include a flexible spine or cable 71 which is configured to engage the internal tray 30*a*. Flexible spine 71 is configured to electrically communicate with the printer PCBA 130 and includes a sensor 47*b* disposed at a distal end thereof which provides information relating to the stock material for printing purpose, e.g., size, type, thickness, low paper alert, etc.

As best shown in FIGS. 4 and 5, the cover tray 30*a* also includes a cover battery compartment 55 defined therein which is dimensioned to releasably and slideably secure battery 60. Cover battery compartment 55 includes a ledge 57 which is configured to force the battery 60 towards the terminal 21*b* when the cover 30 is closed. As can be appreciated by the present disclosure, the closing of cover 30 forces the battery 60 into positive electrical and mechanical engagement within terminal 21*b* disposed in spacer block 21 which provides secure and consistent power to the various internal electrical connections associated with the printer 10.

A flexible print head 70 is located within the cover 30 and is configured to thermally imprint indicia onto the stock material as the stock is advanced through the paper path 100. More particularly, print head 70 mounts within cover 30 between interfaces 39*a* and 39*b* in substantial vertical registration with platen roller 48. Flexible print head 70 is a non-floating type printing head which is configured to be fixed along the X, Y axes and movable in the Z axis only (i.e., movable relative to the platen roller 48). The print head 70 is powered by battery 60 and cooperates with one or more sensors 47*a* disposed in lip 47 of housing tray 20*a*. Additional sensors, e.g., 47*b*, may be positioned within the housing, cover tray 30*a* or cover 30 depending upon a particular purpose. The sensor(s) 47*a* and the flexible print head 70 electrically communicate to regulate printing and alert the user of when the roll of stock is empty. The sensor 47*a* may also be configured to regulate or monitor other printing functions and/or parameters and relay such information back to internally-disposed PCBA 130 or a remote networking connection (not shown) via a transceiver module 69. Other printer functions and/or parameters may include: paper speed, paper thickness, paper malfunction, "out of stock material" alert, "low stock material" alert, printing malfunction, print speed, cover configuration (i.e., open/closed), the temperature of the print head 70, etc. As can be appreciated, other sensors, 47*b*, may also be utilized with sensor 47*a* to regulate the various printing parameters and functions. With particular respect to FIG. 5 and as mentioned above, cover 30 may also include a sensor 47*b* at one end of flexible spine or cable 71 which is engaged within cover tray 30*a* and configured to electrically communicate with the PCBA 130. Sensor 47*b* is disposed in vertical registration with sensor 47*a*. It is envisioned that the two sensors 47*a* and 47*b* may be configured to cooperate with one another to provide information relating to the stock material for printing purpose, e.g., size, type, thickness, low paper alert, etc.

Figure 6:
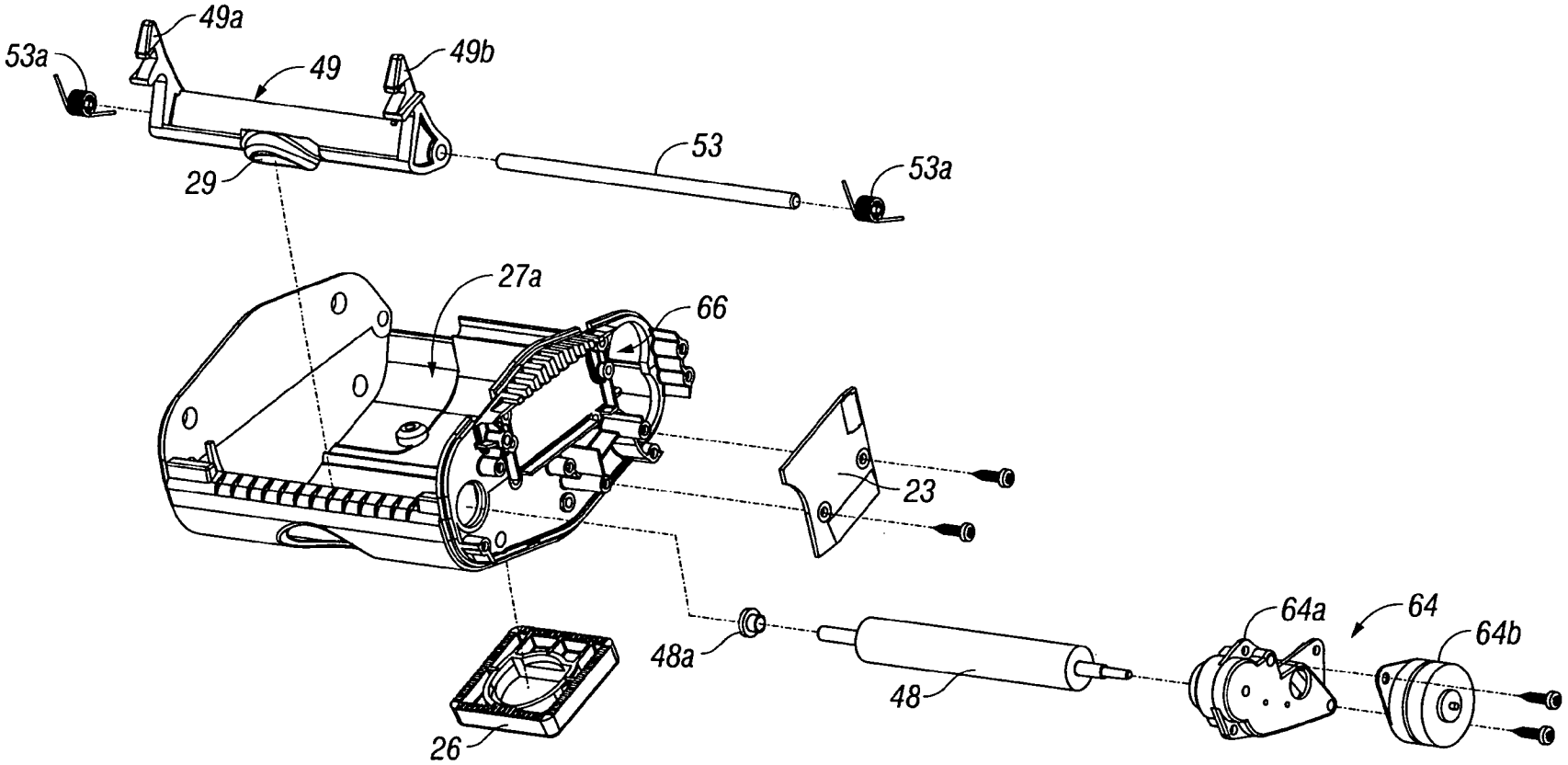
FIG. 6 is an enlarged, perspective view with parts separated showing a housing, release assembly and motor assembly for use with the printer according to the present disclosure.

As best shown in FIGS. 5 and 6, platen roller 48 is configured to advance the stock through the paper path 100. As such, the platen roller 48 is designed to include a surface material designed to both grab and advance the stock material from the roll and through the paper path 100. In the instance where linerless stock is utilized, the platen roller 48 also includes a surface which is generally non-adhereable to the linerless adhesive on the underside of the stock.

A cap 48*a* is included to facilitate mounting the platen 48 in the housing 20. One end of the platen 48 may include a keyed interface 48' which mates with a corresponding interface (not shown) on a drive motor assembly 64 which drives the platen 48 to advance the stock from the roll. Drive motor assembly 64 is configured to securely mount against side 22*b*' and electrically interface with the PCBA 130 and battery 60. Drive motor assembly 64 consists of a two-part stepper motor including components 64*a* and 64*b* which cooperate to drive the platen 48. Other types of drive assemblies are also envisioned as known in the art and may include variable-speed motors, single-speed motors, AC Motors, DC Motors, brushless DC Motors, servo motors, brushed DC servo motors, brushless AC servo motors, stepper motors, linear motors, etc. Internally-disposed gearing (not shown) may also be included in the motor components 64*a* and 64*b* to regulate the rotational speed of the platen 48 as needed to advance the stock.

A spacer block 21 is disposed between sides 22*b* and 22*b*' of the housing 20. Spacer block 21 includes an internal cavity 21*a* defined therein that is configured to house drive motor assembly 64, PCBA 130 and other electrical components described below. The battery charging board 23 is operatively coupled to the PCBA and is configured to manage or regulate the battery level and/or regulate the charging operation of the battery 60 when the printer 10 is engaged to a docking station or connected to a remote power source. As best shown in FIGS. 8A-8C, the spacer block 21 may be replaced with an option block 121 which includes a smart card reader/writer 250 or a magnetic card reader/writer 350. Other types of readers are also contemplated, RFID readers, barcode scanners, Aztec Code scanners, etc. As can be appreciated, during manufacturing and assembly, the user indicates what type of reader is desirable and simply mounts that particular reader in place of the spacer block 21. This greatly facilitates assembly. In addition, combination readers may also be substituted for the spacer block 21, e.g., a magnetic and smart card reader or any other combination of the above-mentioned readers.

As mentioned above, the PCBA 130 may also be configured to control or monitor various other functions and/or parameters of the printer 10 such as paper speed, paper thickness, paper malfunction, printing malfunction, print speed, cover configuration (i.e., open/closed), the temperature of the print head 70, etc. A transceiver module 69 is included which operatively couples to the PCBA 130 and is dimensioned to receive and transmit data and/or operating instructions from a remote networking connection (not shown). Various electrical controls 110*a*-110*c* are positioned on side 22*b* of the housing and configured to electro-mechanically communicate with the PCBA to allow user input and printer control.

Figure 7:
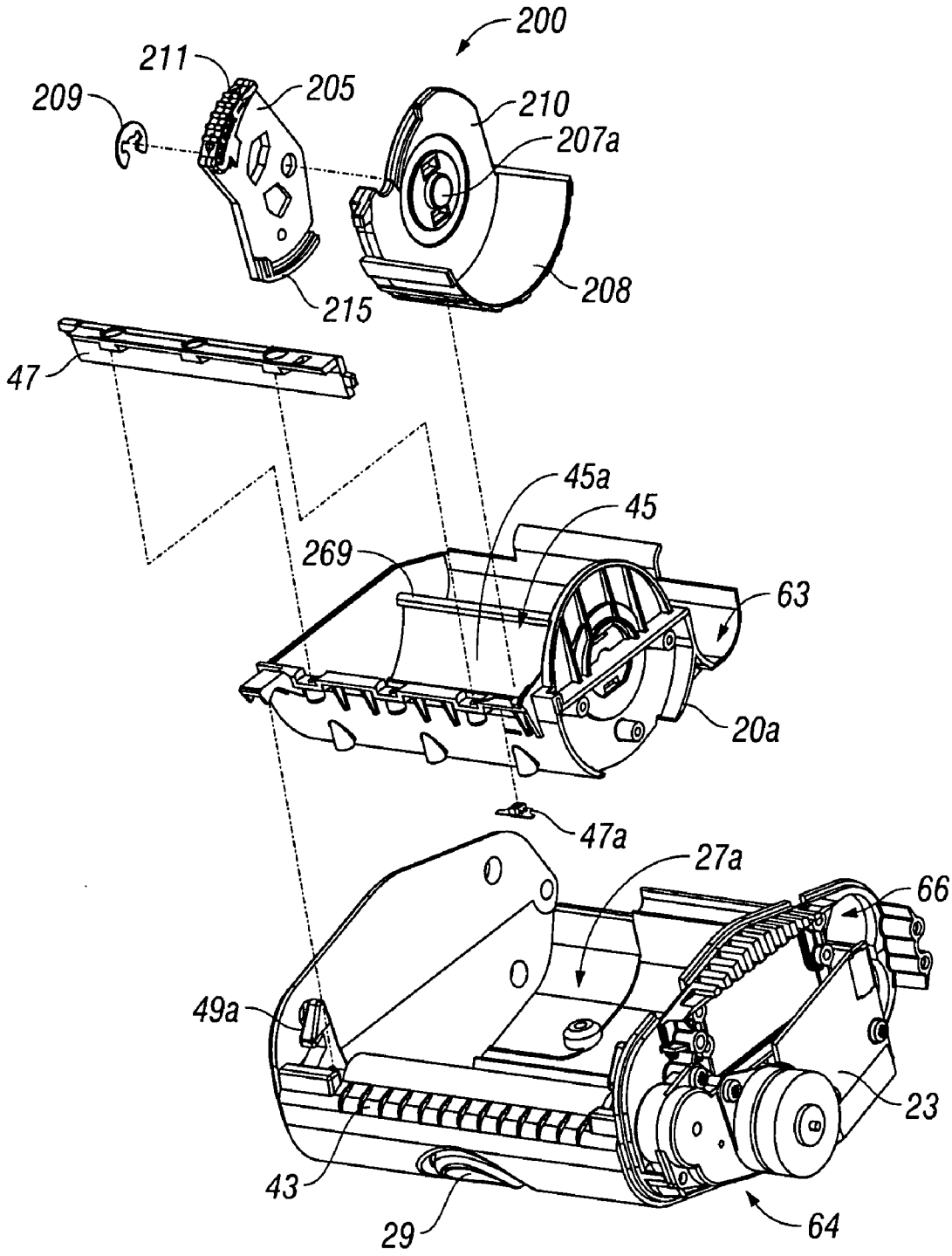
FIG. 7 is an enlarged, perspective view with parts separated showing a housing tray engageable with the housing and a selectively adjustable media support assembly for use with the printer according to the present disclosure.
Figure 8:
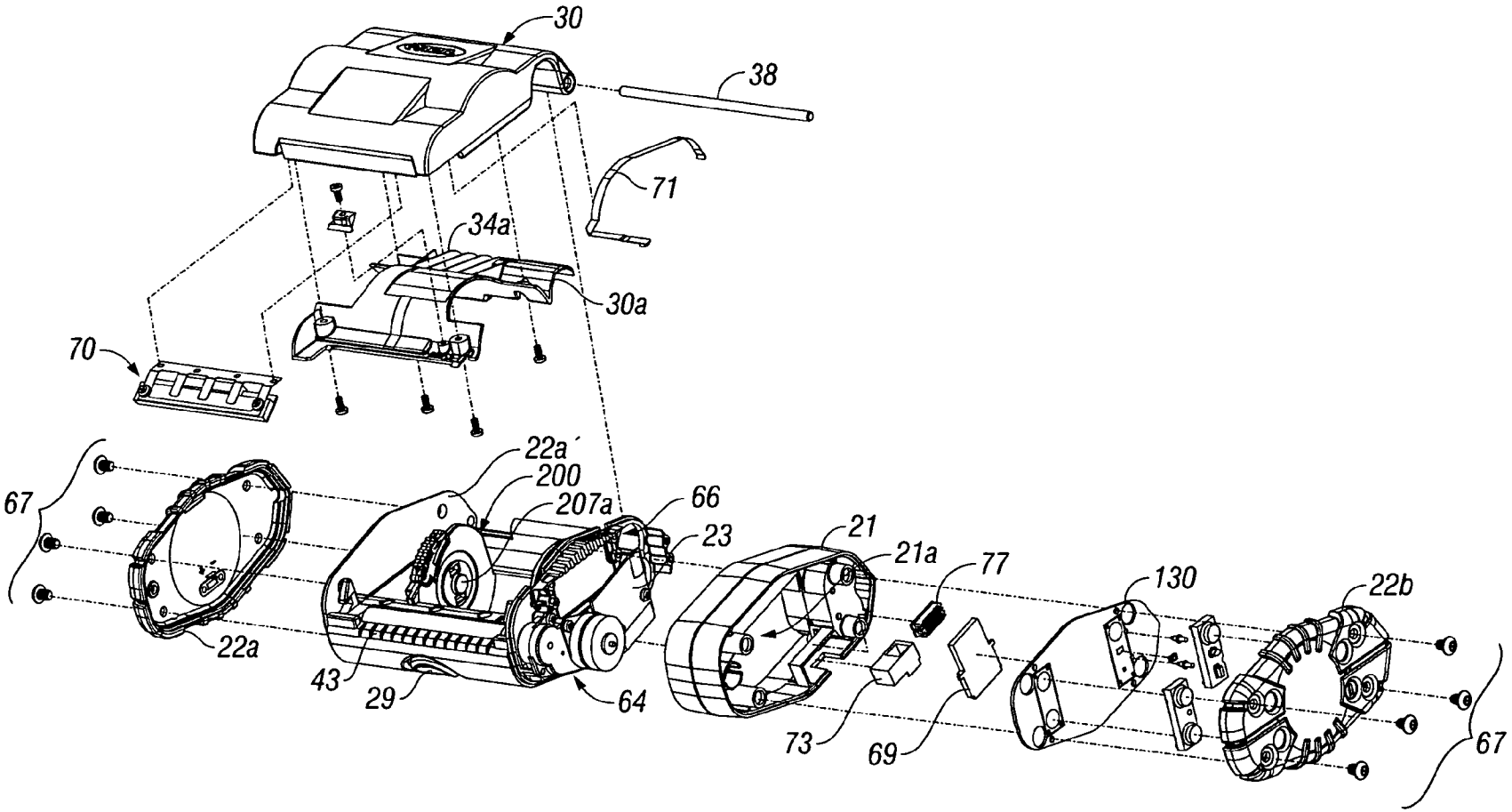
FIG. 8 is an enlarged, perspective view with parts separated showing a spacer block, side plates and a cover assembly which are engageable with the housing for use with the printer according to the present disclosure.

As best shown in FIG. 7, the printer 10 includes a selectively adjustable media support assembly 200 which allows a user to easily adjust the printer 10 for various paper sizes.

Media support assembly 200 is moveable from a first position for supporting a roll of stock material of a first size to a second position for supporting a roll of stock material of a second size. Preferably, the media support assembly 200 adjusts to preset discreet configurations to accept paper stock, e.g., label stock, in standard industry sizes such as 2-inch, 3-inch, 4-inch, etc. It is also envisioned that the adjustable media support assembly may be infinitely adjustable within the printer 10 to accommodate non-standard paper stock sizes.

Media support assembly 200 includes a paper support tray 210 having an arcuately-shaped flange 208 which extends inwardly therefrom configured to at least partially encircle and retain a roll of stock when disposed therein. Paper support tray 210 also includes spindle 207*a* which is configured to cooperate with a corresponding spindle 207*b* (See FIG. 9A) to bracket the roll of stock for rotational purposes. Media support assembly 200 also includes a cam-shaped stanchion 205 which is rotatable from a first orientation which allows selective sliding adjustment of the paper tray 210 to a second orientation which locks the paper tray 210 against the media support tray 20*a*. More particularly, the rotatable stanchion 205 essentially acts like an eccentric cam such that the user can freely slide and adjust the paper tray 210 against a roll of particularly-sized stock and then rotate the stanchion 205 to lock the roll of stock in place for printing. When disposed in the first orientation, the cam shaped stanchion 205 prevents closing and latching of the cover 30. As can be appreciated, this assures the user that the stock material is secured prior to operation of the printer 10.

The bottom of the cam-like stanchion 205 includes a flexible flange 215 which is configured to wedge against the bottom 45*a* of tray 20*a* to lock the media support assembly 200 in place. Flexible flange 215 may be made from an elastomeric material with high friction properties to enhance the locking power of the stanchion 205 against tray 20*a*.

The upper portion or user friendly portion of the stanchion 205 may include one or more ergonomically enhanced features such as a figure tab 211 to facilitate rotation of the stanchion 205 from an unlocked orientation to a locked orientation. A spring clip 209 (or any other mechanical attachment) may be used to lock the stanchion 205 to the paper support tray 210. The paper support tray 210 may also include a flange 69 at a rear thereof which matingly engages a corresponding shelf 269 in housing tray 20*a* to facilitate consistent sliding movement of the paper support tray 210 within the housing 20 (See FIGS. 9A-9C).

Figure 9A:
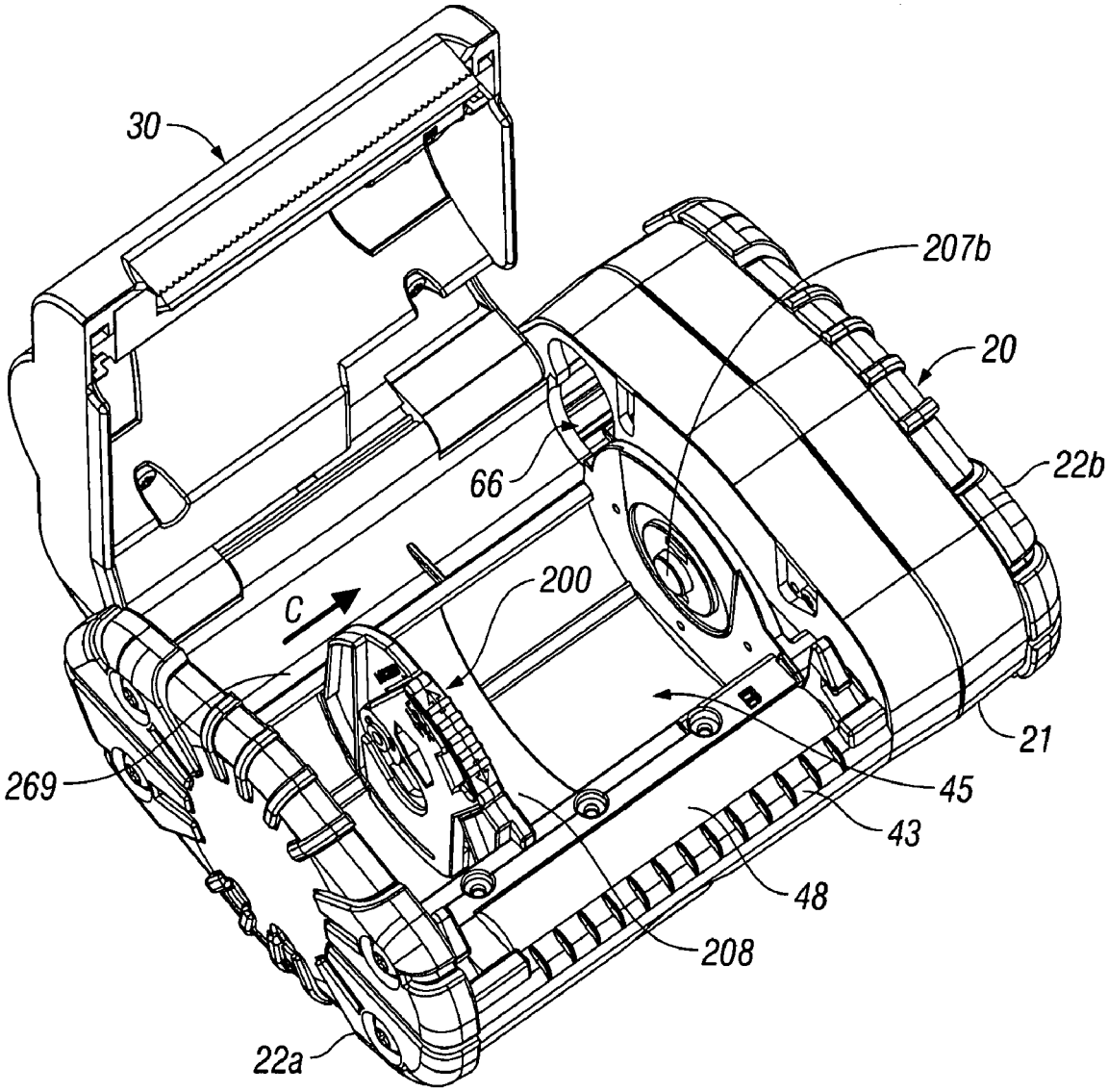
FIGS. 9A-9C are front perspective views of the printer according to the present disclosure showing the actuation sequence of the selectively adjustable media support assembly.
Figure 9B:
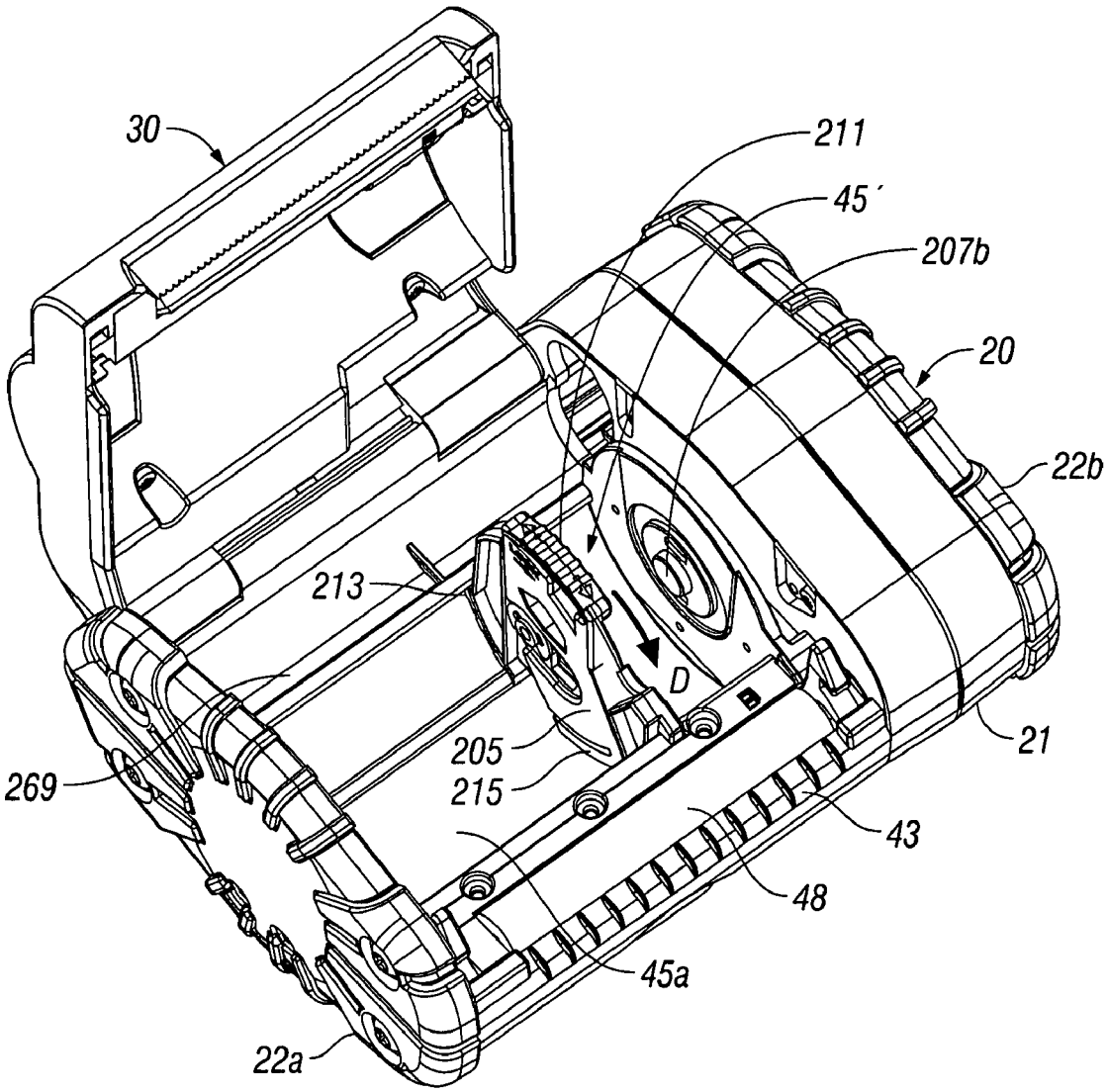
Figure 9C:
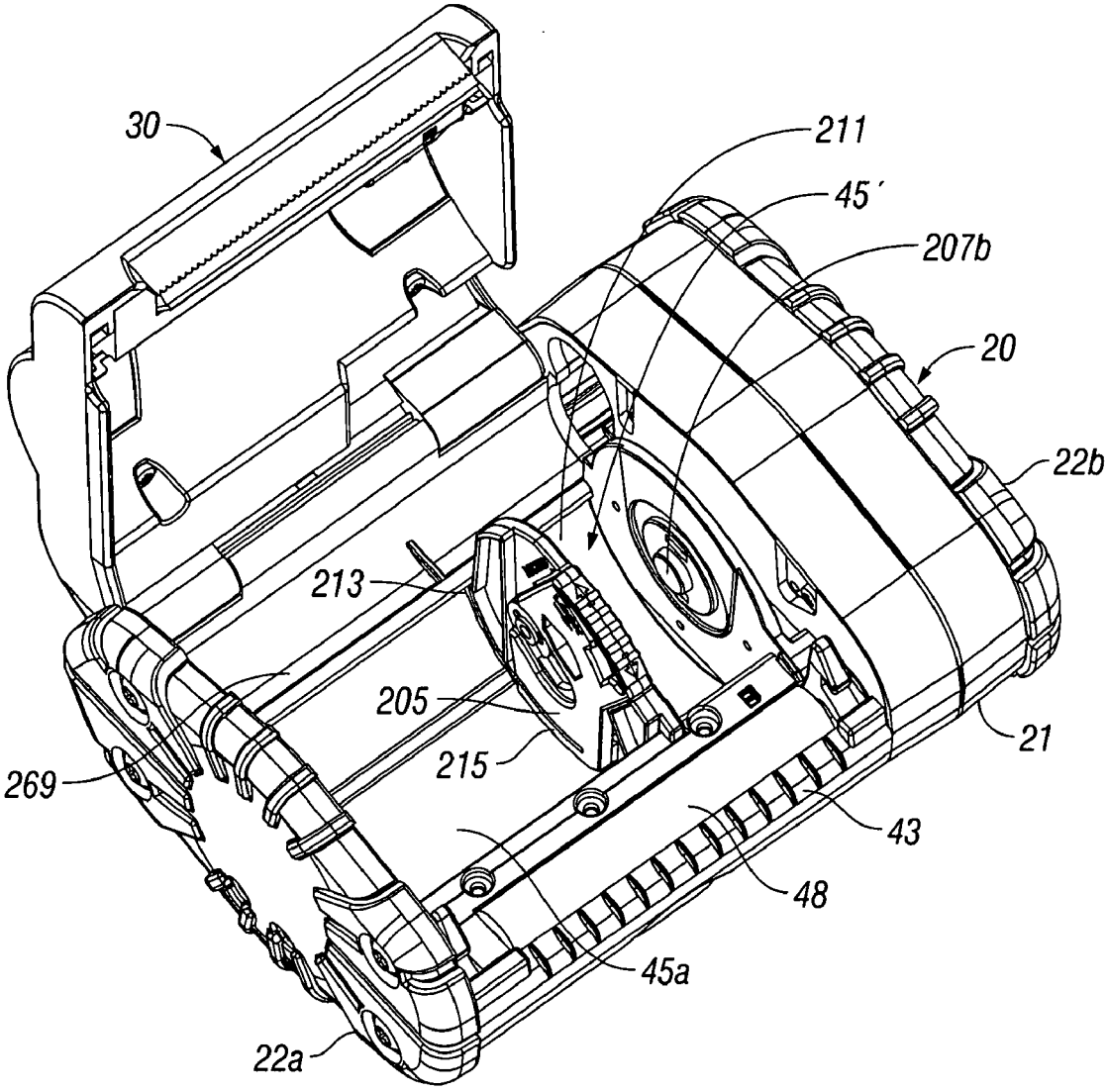
Figure 10A:
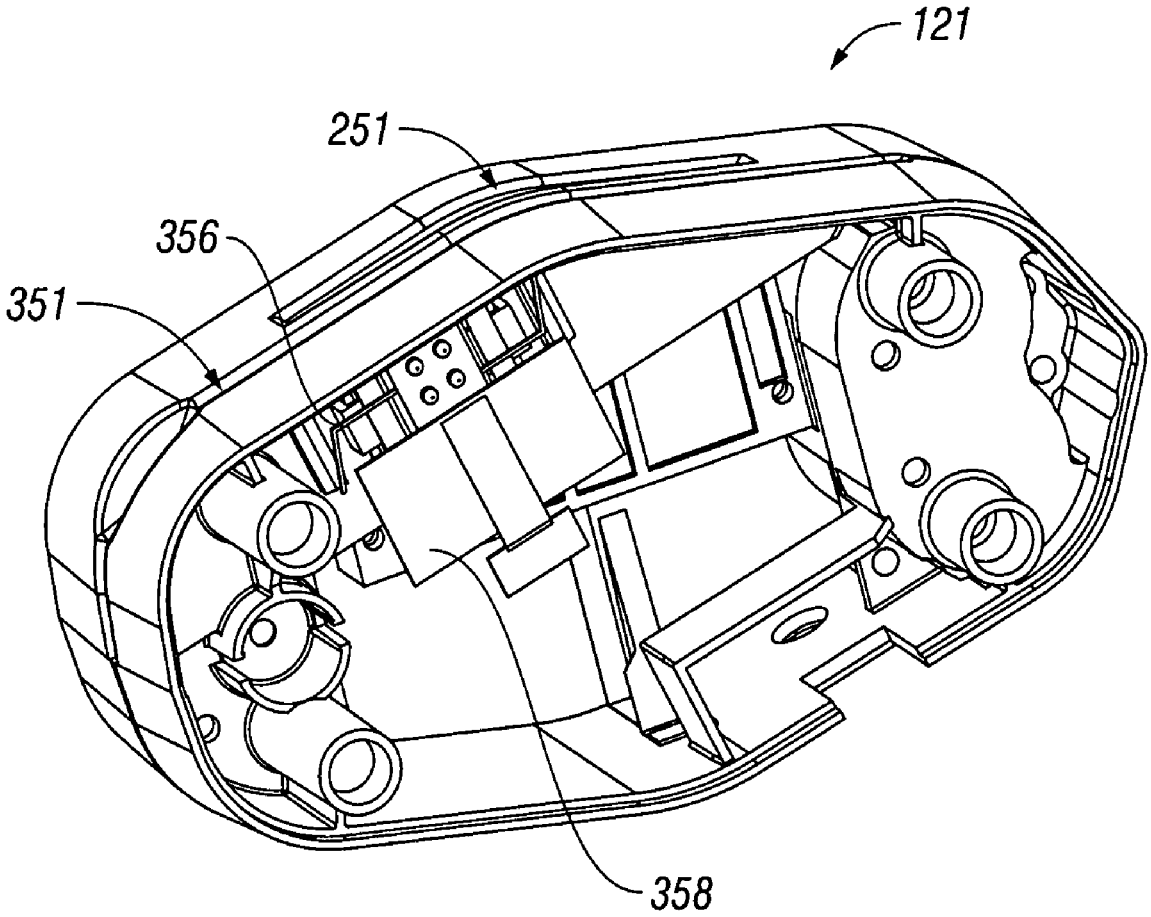
FIG. 10A is an enlarged, left perspective view of an option block for use with the printer according to the present disclosure.
Figure 10B:
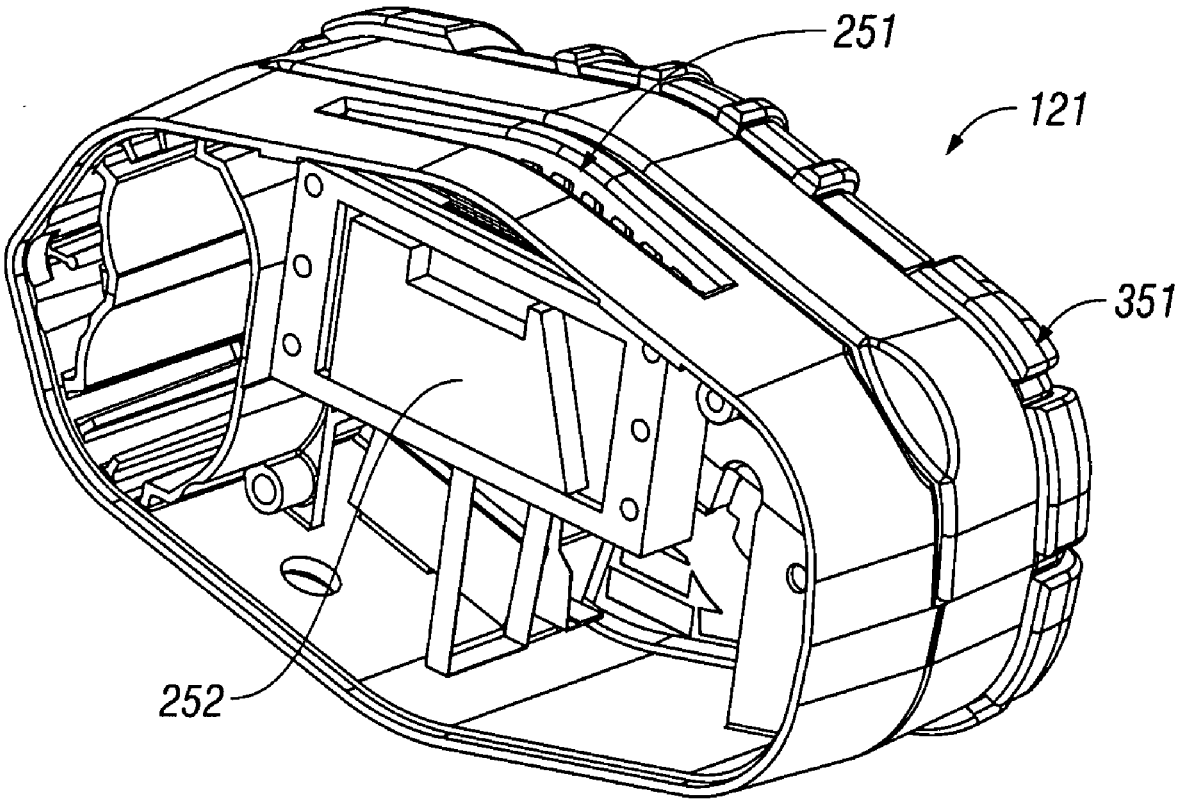
FIG. 10B is an enlarged, right perspective view of an option block for use with the printer according to the present disclosure.
Figure 10C:
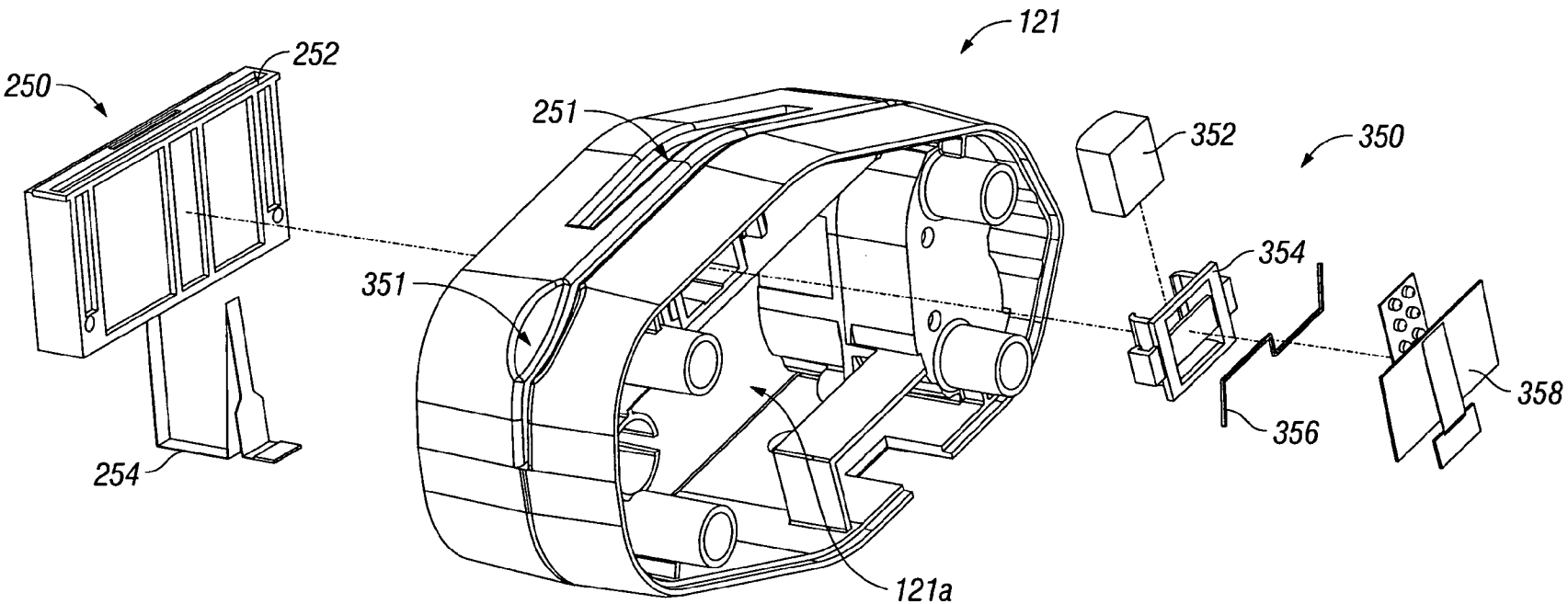
FIG. 10C is an enlarged, perspective view with parts separated showing an optional smart card reader and magnetic card reader for use with the printer according to the present disclosure.

In operation, the user actuates the release lock 29 to unlock the cover 30 with respect to the housing 20. A roll of stock material is loaded and engaged for rotation within the media support assembly 200 between spindles 207*a* and 207*b*. As best shown in FIGS. 9A-9C, the media support assembly 200 is slid inwardly in the direction of arrow "C" such that the paper stock engages spindle 207*b*. Once the paper is slid into proper position against spindle 207*b*, stanchion 205 is rotated in the direction of arrow "D" to lock the media support 200 for printing purposes.

An edge of the stock is then pulled over lips 47 and 43. The battery 60 is loaded within battery compartment 63 and moved towards terminal 21*b*. Once the stanchion 205 is rotated and locked to secure the stock material, the user then closes the cover 30 which locks with the housing 20 by virtue of locking release mechanism 49. As the cover 30 is closed, the ledge 57 of the cover battery compartment 55 in cover 30 forces the battery 60 into positive engagement within terminal 21*b* to power the internal electrical connections disposed in the housing 20. Closing the cover 30 also aligns the paper in vertical registration with the print head 70.

The user then turns the printer 10 to "wake" from a "sleep mode" by actuating one of the controls, e.g., 110*a*, on the side 22*b* of the housing 20. The printer 10 may be configured to go through a series of start-up tests before readying for printing, e.g., the PCBA 130 queries the sensor 47*a* (or both sensors 47*a* and 47*b*) whether paper is loaded and properly positioned within the printer 10 prior to allowing printing to commence. The PCBA 130 may also individually query the other sensors 47*b* to determine paper size or other printing parameters relating to the paper stock. Other tests may also be performed such as querying the network host for instructions or configuration settings. The PCBA 130 may also include various subroutines and algorithms which control, inter alia, the printing speed and/or print output of the printer.

To unload or replace the battery 60 from the housing 20, the user simply grasps the exposed end of the battery 60 and tilts the exposed end towards the terminal 21*b*. This disengages the battery 60 from the terminal 21*b* and allows the battery 60 to be pulled or slid out of the housing 20 for replacement purposes. To unload the paper, the user simply rotates the stanchion 205 in the opposite direction to unlock the paper support tray 210 such that the paper tray 210 may be slid outwardly (i.e., opposite arrow "C") to unload the paper for replacement.

The printer 10 communicates with the host computer or network connection to enable printing. As such, various instructions and data are transmitted to the PCBA 130 and the operator may selectively initiate printing as desired, or alternatively, the host or network connection may initiate printing remotely. The printer 10 may also transmit information (e.g., configuration setting, operating parameters, etc.) back to the host computer or network connection. When inactive, the printer 10 is designed to power down to a so-called "sleep mode" and essentially "wake up" when any radiofrequency signal is received from the network connection, the user initiates a print command or one or more of the electrical controls is activated. The printer 10 may also be configured to awake on the reception of another type of signal, RFID signal, RS232 signal, infrared signal (IRdA), Bluetooth signal, USB signal, etc. As can be appreciated, the various components relative to these different communication elements, e.g., ports, electrical components, etc. may be included as required to allow the printer 10 to operate in this fashion. For example, one envisioned printer includes a USB or data port 73 which electrically connects to the PCBA 130 to allow communication between the printer and one or more external devices. One or more flexible connectors 77 may be utilized to provide electrical continuity among the various electrical components.

As mentioned above, FIGS. 8A-8C show one envisioned embodiment wherein an option block 121 may be used to replace the spacer block 21. FIGS. 8A-8C actually show a combination option block 121 which employs both a smart card reader 250 and a magnetic card reader 350 therein. It is contemplated that option block 121 may be configured to only include the smart card reader 250 or the magnetic card reader 350 or both. Optionally, the option block 121 may be sold as shown with only the smart card reader 250 including the electronic components disposed therein or, likewise, the magnetic card reader 350 may be sold in the same fashion.

As best shown FIG. 8C, option block 121 includes both the smart card reader 250 and the magnetic card reader 350. Smart card reader is disposed within cavity 121*a* defined in option block 121 and includes a reader 252 which electrically communicates with PCBA 130. A clip or flexible cable connection may be included which electrically couples to the PCBA board 130. Smart card reader 250 when disposed in cavity 121*a* aligns in an offset fashion with a slot 251 defined in option block 121 thereby allowing a user to insert a smart card (not shown) into slot 251 for reading and/or writing purposes.

Magnetic card reader 350 includes a read/write head 352 which mounts within cavity 121*a* by way of a clip 354. A flexible cable connect 358 is operative coupled to the clip 354 and configured for electrically communication with head 352. A spring clip may be utilized to facilitate mounting the magnetic card reader 350 within cavity 121*a*. Magnetic card reader 350 when disposed in cavity 121*a* aligns in an offset fashion with a slot 351 defined in option block 121 thereby allowing a user to insert a card (not shown) into slot 351 for reading and/or writing purposes.

Figure 11:
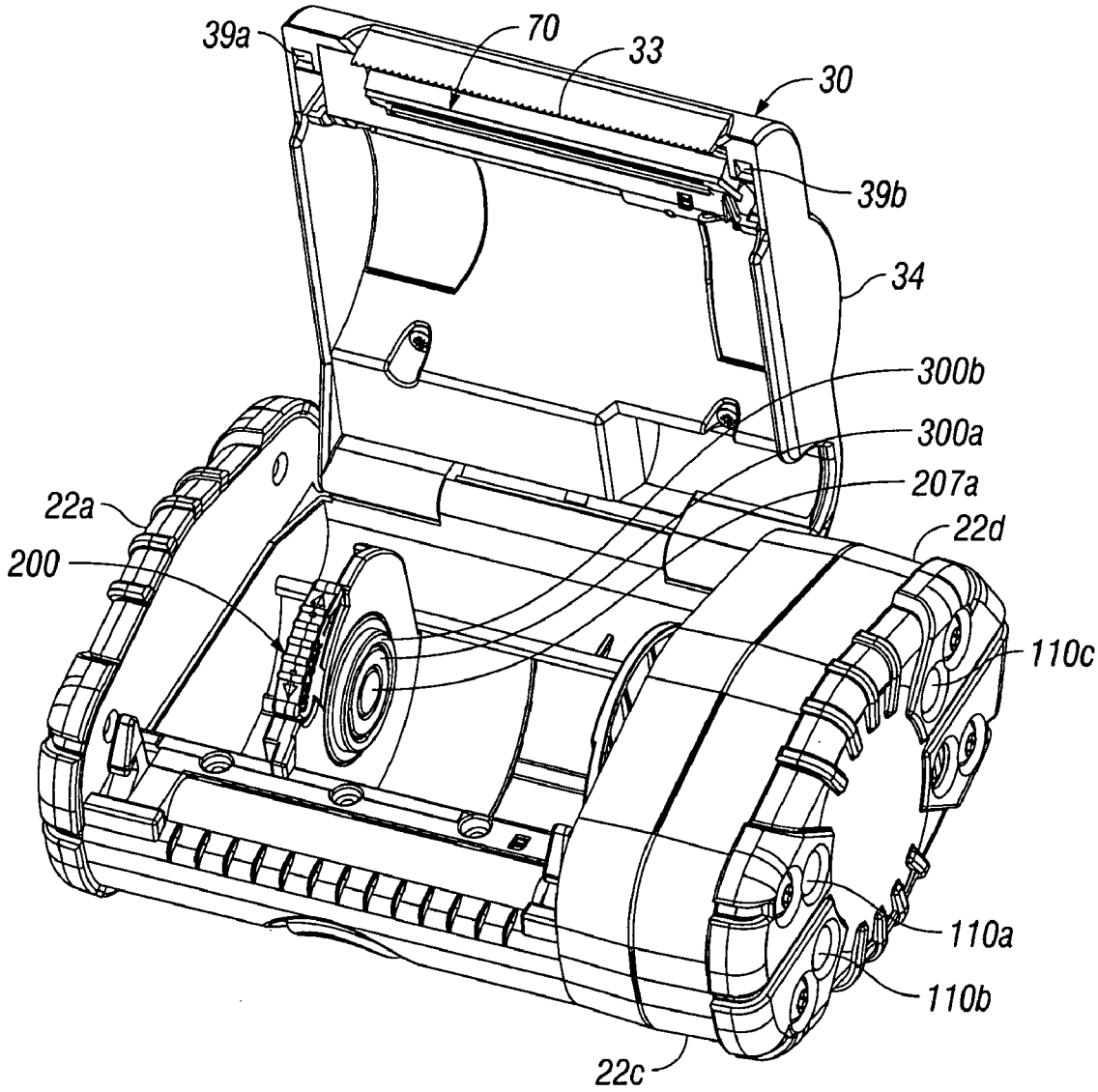
FIG. 11 is an enlarged, perspective view showing a series of snap inserts which may be utilized for different stock material having varying diameters.

FIG. 11 shows a series of snap inserts 300*a*-300*b* which may be utilized to accommodate rolls of stock material with varying diameters. For example, the inserts are selectively configurable to allow a user to easily customize the selectively adjustable media support assembly 200 for different types and/or size rolls of stock, 2-inch, 3-inch, etc. which may, in some instances, include diameters of different sizes. Preferably, the snap inserts 300 are generally concentrically arranged to nestingly receive one another to facilitate assembly from an old diameter size to it new diameter size.

Figure 12:
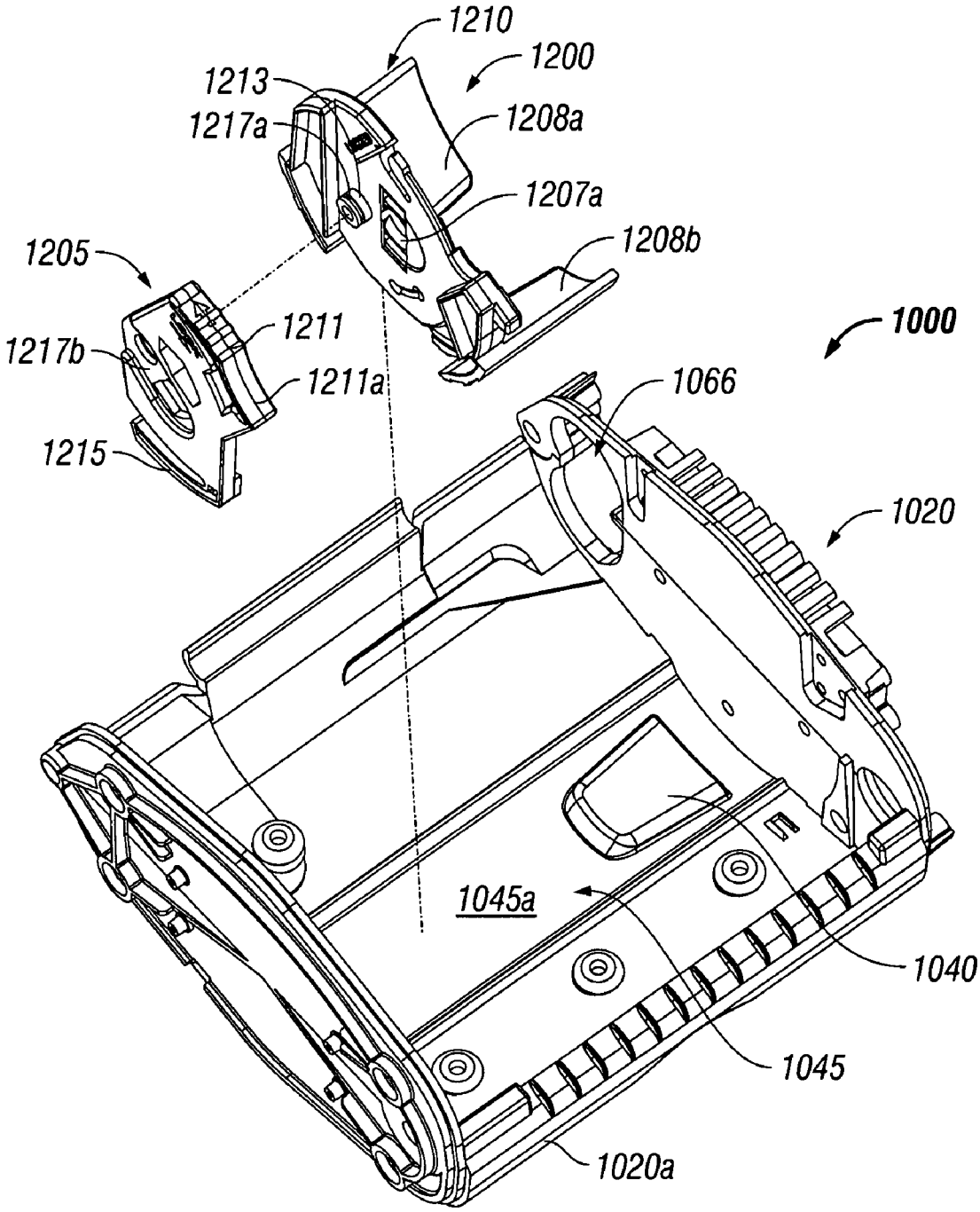
FIG. 12 shows an alternate embodiment of a portable label printer and adjustable media support assembly in accordance with another embodiment of the present disclosure.
Figure 13A:
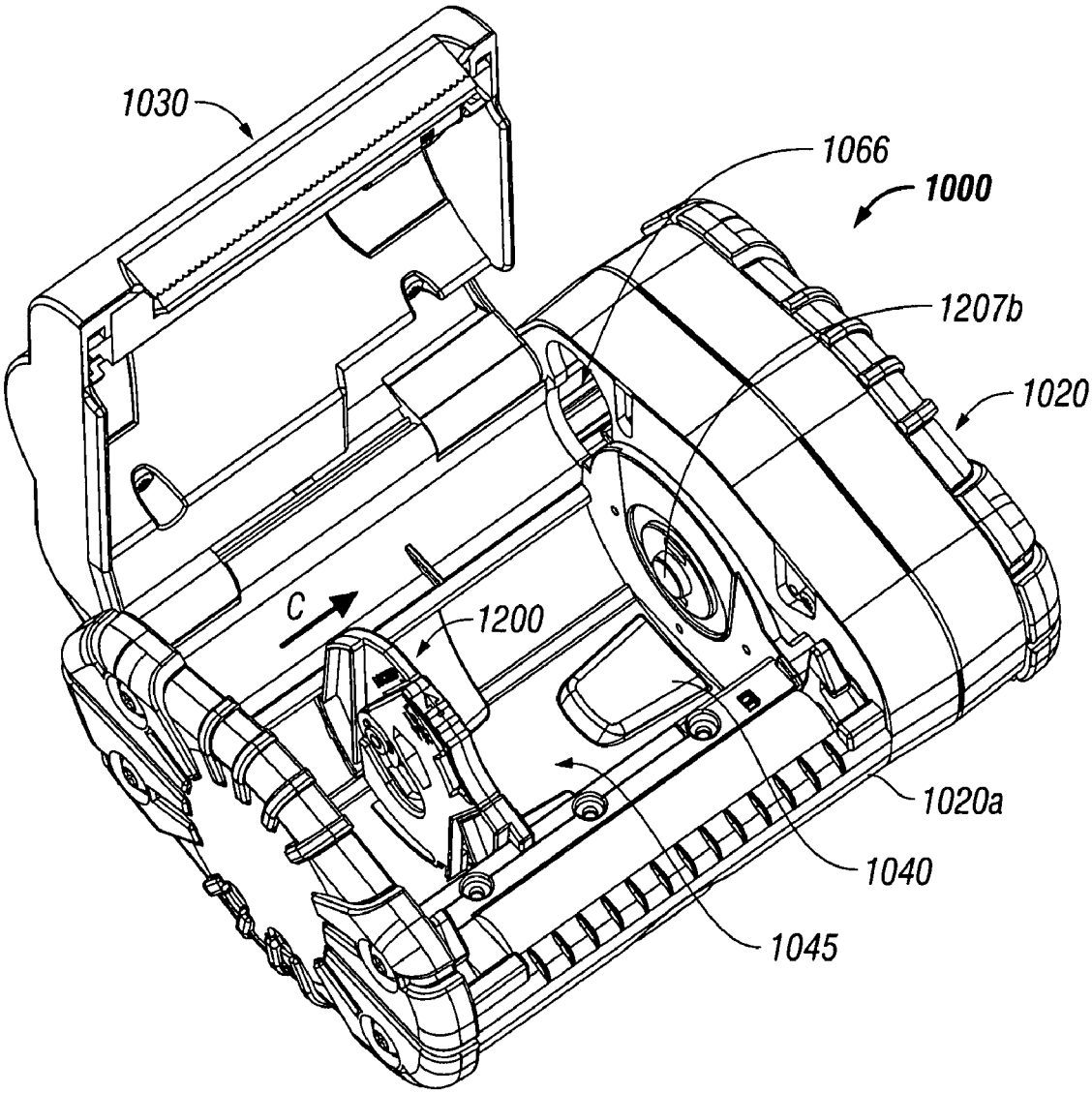
FIGS. 13A-13C are front perspective views of the printer of FIG. 12 showing the actuation sequence of the selectively adjustable media support assembly.
Figure 13B:
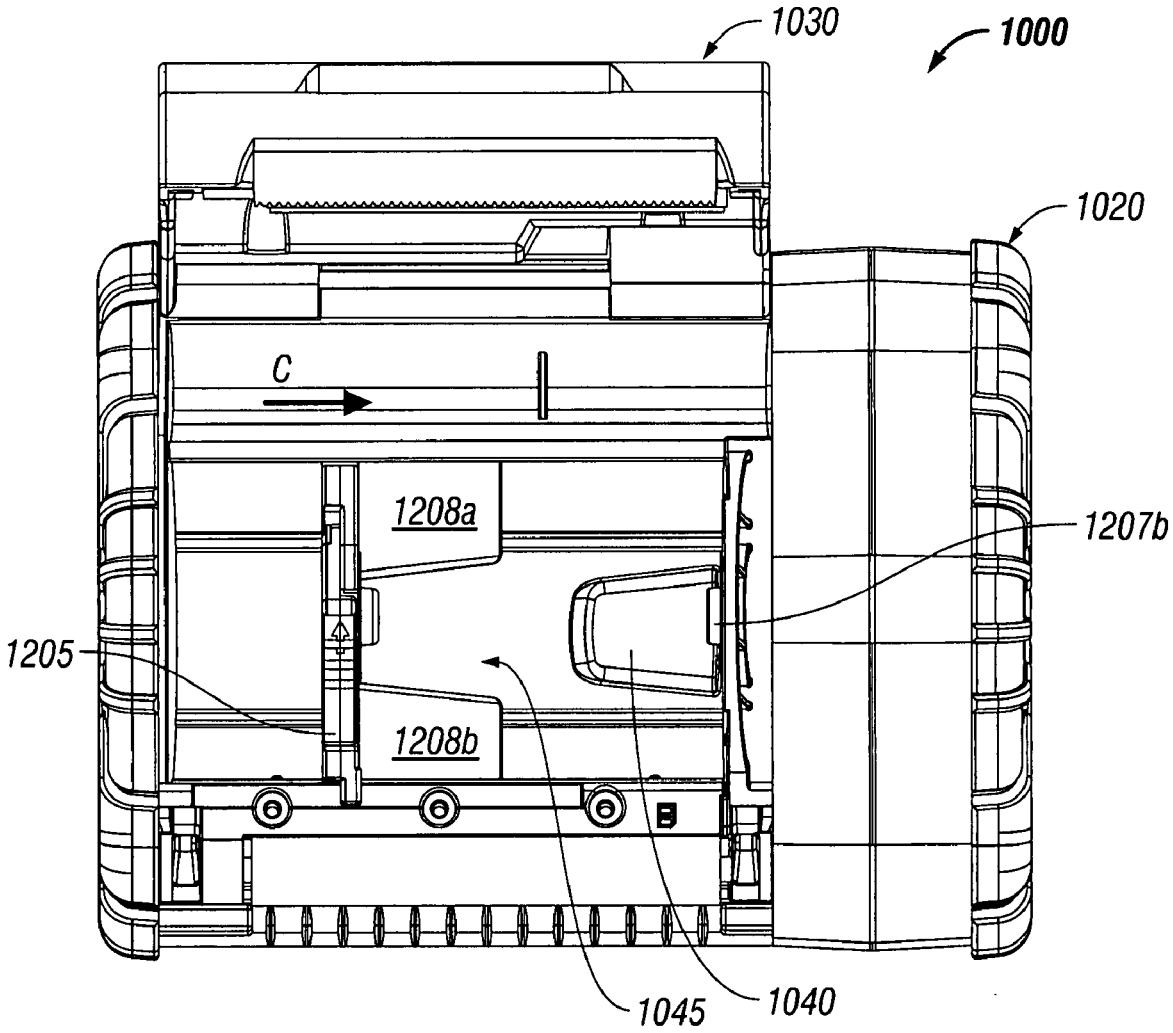
Figure 13C:
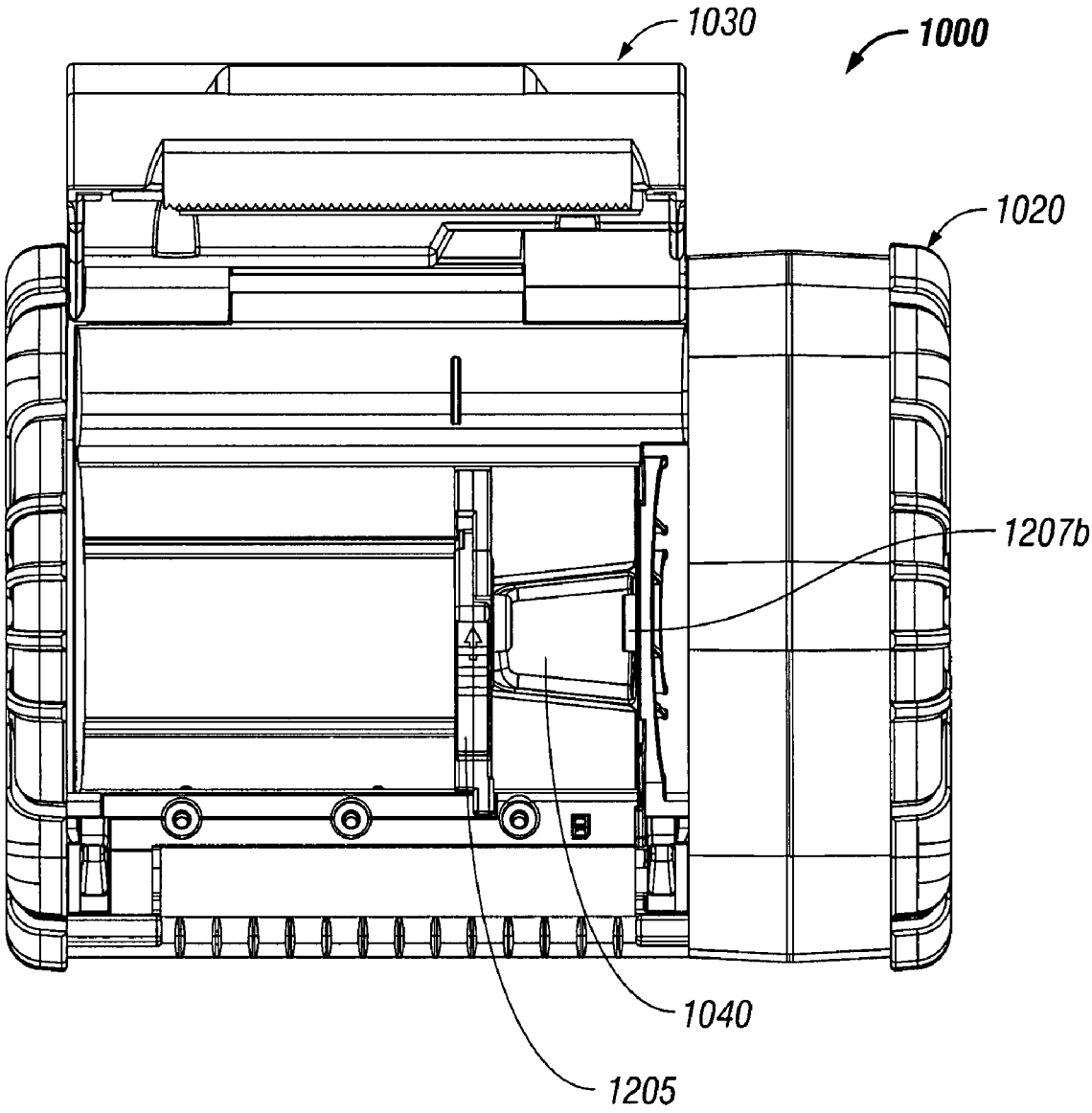

FIGS. 12-13C show another embodiment of a portable printer 1000 for use with variously-sized label stock. Similar to FIGS. 1-11, printer 1000 includes a housing 1020 defined by sides and a selectively openable cover 1030 for accessing the internal operating components of the housing 1020. Housing 1020 also includes a bottom tray 1020*a* which defines a cavity 1045 configured and dimensioned to receive a roll of stock material for printing indicia thereon (see FIG. 5).

Printer 1000 includes a selectively adjustable media support assembly 1200 which allows a user to easily adjust the printer 1000 for various paper sizes. Much like the above described media support assembly 200, media assembly 1200 is moveable from a first position for supporting a roll of stock material of a first size to a second position for supporting a roll of stock material of a second size (See arrow "C" of FIGS. 13A-13C). Media support assembly 1200 includes a paper support tray 1210 which is bifurcated to define a pair of arcuately-shaped flanges 1208*a* and 1208*b* which extend inwardly therefrom and which are configured to at least partially encircle and retain a roll of stock when disposed therein. Paper support tray 1210 also includes spindle 1207*a* which is configured to cooperate with a corresponding spindle 1207*b* (See FIGS. 13A-13C) to bracket the roll of stock for rotational purposes.

Media support assembly 1200 also includes a cam-shaped stanchion 1205 which is rotatable from a first orientation which allows selective sliding adjustment of the paper tray 1210 to a second orientation which locks the paper tray 1210 against the media support tray 1020*a*. Stanchion 1205 operates in a similar fashion to stanchion 205 described above. More particularly, the rotatable stanchion 1205 acts like an eccentric cam such that the user can freely slide and adjust the paper tray 1210 against a roll of particularly-sized stock and then rotate the stanchion 1205 to lock the roll of stock in place for printing. When disposed in the first orientation, the cam shaped stanchion 1205 prevents closing and latching of the cover 1030. As can be appreciated, this assures the user that the stock material is secured prior to operation of the printer 1000.

Similar to cam-like stanchion 205 described above, the bottom of the cam-like stanchion 1205 includes a flexible flange 1215 which is configured to wedge against the bottom 1045*a* of tray 1020*a* to lock the media support assembly 1200 in place. In this particular embodiment, flexible flange 1215 is made from a thick and durable elastomeric material with higher friction properties to further enhance the locking power of the stanchion 1205 against tray 1020*a*. Cam-like stanchion 1205 also includes an ergonomically-friendly finger tab 1211 having an arcuate flange section 1211*a* which facilitates rotation thereof and a series of mechanical interfaces 1217*b* which cooperate with a corresponding series of mechanical interfaces 1217*a* on the media support assembly 1200 to regulate and facilitate consistent locking and unlocking of the cam-like stanchion 1205 against the bottom 1045*a* of the support tray 1020*a*.

Bottom support tray 1020*a* may also include a raised tongue-like platform 1040 which is configured to help support the stock material during installation. The tongue-like platform 1040 is also configured to interleave (or interface between) the bifurcated flanges 1208*a* and 1208*b* of media support assembly 1200 when the media support assembly 1200 is moved in the direction of arrow "C" (See FIGS. 13A and 13B). The flanges 1208*a*, 1208*b* and the tongue-like platform 1040 cooperate to evenly support the ends of the stock material when loaded into the media support assembly 1200.

From the foregoing and with reference to the various figure drawings, those skilled in the art will appreciate that certain modifications can also be made to the present disclosure without departing from the scope of the same. For example, it envisioned that linerless paper or linered paper may be utilized with the printer 10 depending upon a particular purpose.

It is also envisioned that the cover 30 and cover tray 30*a* may be partially translucent to allow a user to visually inspect the stock for replacement purposes. The flexible print head 70 may be engaged in a snap-fit or slide-fit manner within the cover 30 to allow replacement thereof in the case of a malfunction or when the print head 70 needs replacement.

In another embodiment, the paper stock material may include an indicator included therewith which is configured to communicate with one of the sensors to alert the user prior to an "out of stock material" or "low stock material" alert. For example, the last couple of revolutions of the roll may be constructed from a different stock material, a different color stock material or a different thickness stock material which is easily sensed by the sensor to alert the user of a low stock condition.

The printer may also include one or more terminals which allow the printer to electrically couple to a docking station for charging purposes or to retrieve data from a terminal.

While several embodiments of the disclosure have been shown in the drawings, it is not intended that the disclosure be limited thereto, as it is intended that the disclosure be as broad in scope as the art will allow and that the specification be read likewise. Therefore, the above description should not be construed as limiting, but merely as exemplifications of particular embodiments. Those skilled in the art will envision other modifications within the scope and spirit of the claims appended hereto.

What is claimed:

1. A portable printer, comprising:

a housing having a cavity defined therein which supports a roll of stock material for printing indicia thereon, the housing including a drive motor assembly configured to move the stock material through a paper path defined in the housing;

a battery loadable within a battery compartment disposed in the cavity;

a cover assembly pivotably supported on the housing and moveable from an open configuration for loading the roll of stock material to a closed configuration to enable printing; and a selectively adjustable media support assembly which supports the roll of stock material, the media support assembly including a paper tray being slideable within a media support tray from a first position for supporting a roll of stock material of a first size, to a second position for supporting a roll of stock material of a second size, the paper tray including a stanchion having an eccentric cam face configured to engage the media support tray and being rotatable about an axis parallel to a center axis of the roll of stock material from a first orientation which allows selective sliding adjustment of the paper tray wherein the eccentric cam face of the stanchion is disengaged from the media support tray, to a second orientation which prevents sliding adjustment of the paper tray wherein the eccentric cam face of the stanchion engages the media support tray.

2. A portable printer according to claim 1 wherein the media support assembly includes an arcuately-shaped flange which extends inwardly therefrom which engages and at least partially encircles the roll of stock material when the media support assembly is slid into engagement with roll of stock material.

3. A portable printer according to claim 1 wherein the stanchion includes a series of ribs which facilitate the rotation thereof between the first and second orientations.

4. A portable printer according to claim 1 further comprising a release mechanism operably coupled to the housing and engageable with the cover assembly when the cover assembly is moved to the closed configuration.

5. A portable printer according to claim 4 wherein the release mechanism includes a pair of catches which mechanically engage a corresponding pair of mechanical interfaces on the cover assembly to secure the cover assembly relative to the housing.

6. A portable printer according to claim 1 wherein the portable primer further comprises a platen roller operably coupled to the drive assembly, the platen roller being made from a material which pulls the roll of stock material through the paper path.

7. A portable printer according to claim 1 wherein the housing includes at least one sensor disposed therein, the at least one sensor being configured to at least one of regulate and monitor printing functions and parameters.

8. A portable printer according to claim 7 wherein the at least one sensor is configured to relay information relating to printing functions and parameters back to at least one of an internally-disposed PC board and remote network connection.

9. A portable printer according to claim 7 wherein the printing functions and parameters are selected from the group consisting of size of stock material, stock material speed, out of stock material alert, low stock material alert, stock material thickness, stock material malfunction, printing malfunction, print speed, cover configuration, print head temperature and combinations thereof.

10. A portable printer according to claim 1 wherein a flexible print head is releasably mounted to the cover assembly.

11. A portable printer according to claim 1 wherein the selectively adjustable media support assembly includes a plurality of interchangeable snap inserts for supporting rolls of stock of varying diameters.

12. A portable printer according to claim 1 wherein the stanchion of the selectively adjustable media support assembly prevents the cover assembly from moving to the closed configuration when the stanchion is disposed in the first orientation.

13. A portable printer, comprising:

a housing having a cavity defined therein which supports a roll of stock material for printing indicia thereon, the housing including a drive motor assembly configured to move the stock material through a paper path defined in the housing;

a battery loadable within a battery compartment disposed in the cavity;

a cover assembly pivotably supported on the housing and moveable from an open configuration for loading the roll of stock material to a closed configuration to enable printing;

a selectively adjustable media support assembly which supports the roll of stock material, the media support assembly including a paper tray having being slideable within a media support tray from a first position for supporting a roll of stock material of a first size to a second position for supporting a roll of stock material of a second size, the paper tray including a stanchion having an eccentric cam face configured to engage the media support tray and being rotatable about an axis parallel to a center axis of the roll of stock material from a first orientation which allows selective sliding adjustment of the paper tray and stanchion to a second orientation which locks the stanchion against the media support tray, the paper support tray including an arcuately-shaped flange which extends inwardly therefrom, the arcuately-shaped flange engages and at least partially encircles the roll of stock material when the paper support tray is slid to the second position; and at least one sensor disposed in the housing, the at least one sensor being configured to automatically sense information relating to the roll of stock material and relay the information hack to at least one of an internally-disposed PC board and remote network connection.

14. A portable printer according to claim 13 wherein the information is selected from the group consisting of size of stock material, type of stock material, out of stock material alert and low stock material alert.

15. A portable printer, comprising:

a housing having a cavity defined therein which supports a roll of stock material for printing indicia thereon, the housing including a drive motor assembly configured to move the stock material through a paper path defined in the housing;

a battery loadable within a battery compartment disposed in the cavity;

a cover assembly pivotal supported on the housing and moveable from an open configuration for loading the roll of stock material to a closed configuration to enable printing; and a selectively adjustable media support assembly which supports the roll of stock material, the media support assembly including a paper tray being slideable within a media support tray from a first position for loading a roll of stock material of a particular size, to a second position for securely supporting the roll of stock material in the housing, the paper tray including a stanchion having an eccentric cam face configured to engage the media support tray and being rotatable about an axis parallel to a center axis of the roll of stock material from a first orientation which allows selective sliding adjustment of the paper tray and stanchion to a second orientation wherein the eccentric cam face of the stanchion engages the media support tray.

16. A portable printer according to claim 15 wherein the media support assembly includes an arcuately-shaped flange which extends inwardly therefrom which engages and at least partially encircles the roll of stock material when the media support assembly is slid into the second position.

* * * * *